US007578249B2

(12) United States Patent
Morgante et al.

(10) Patent No.: US 7,578,249 B2
(45) Date of Patent: Aug. 25, 2009

(54) TUFTING MACHINE HEAD SHAKER

(75) Inventors: Michael R. Morgante, Chattanooga, TN (US); Paul E. Beatty, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 0 days.

(21) Appl. No.: 12/056,267

(22) Filed: Mar. 26, 2008

(65) Prior Publication Data

US 2008/0245181 A1 Oct. 9, 2008

Related U.S. Application Data

(60) Provisional application No. 60/908,071, filed on Mar. 26, 2007.

(51) Int. Cl.
*D05C 15/08* (2006.01)
*D05C 7/00* (2006.01)

(52) U.S. Cl. ..... 112/80.01

(58) Field of Classification Search ..... 112/80.01, 112/80.4–80.45, 98
See application file for complete search history.

(56) References Cited

U.S. PATENT DOCUMENTS

| | | | | |
|---|---|---|---|---|
| 3,800,718 | A * | 4/1974 | Johnson | 112/80.01 |
| 4,586,446 | A * | 5/1986 | Cooper | 112/80.73 |
| 4,665,845 | A * | 5/1987 | Card et al. | 112/80.4 |
| 4,895,087 | A * | 1/1990 | Amos | 112/80.18 |
| 5,186,113 | A * | 2/1993 | Green | 112/80.42 |
| 5,287,819 | A * | 2/1994 | Beatty et al. | 112/80.01 |
| 5,572,939 | A * | 11/1996 | Beatty | 112/80.4 |
| 5,769,012 | A * | 6/1998 | Vaughan et al. | 112/80.23 |
| 5,857,422 | A * | 1/1999 | Neely et al. | 112/80.55 |

* cited by examiner

*Primary Examiner*—Ismael Izaguirre
(74) *Attorney, Agent, or Firm*—Douglas T. Johnson

(57) ABSTRACT

An antivibratory system is provided by means of a servo motor driven shaker affixed to the head or bed frame of a tufting machine and programmed for rotation of a balancing weight to minimize vibration caused by operation of tufting machine at a particular speeds and needle stroke lengths.

20 Claims, 9 Drawing Sheets

TUFTING MACHINE HEAD SHAKER

The present application claims priority to the Mar. 26, 2007 filing date of provisional patent application, U.S. Ser. No. 60/908,071 which is incorporated herein by reference.

FIELD OF THE INVENTION

The present invention relates to tufting machines and most particularly to vibration control for high speed tufting machines.

BACKGROUND OF THE INVENTION

In tufting machines, it is desirable to provide a driving mechanism that permits the tufting machine to operate at relatively high speeds and that also is adjustable to permit tufting of varying lengths of yarn through backing material. Typically, the variation in tufting is accomplished by altering the stroke of the needle bar as with the use of cams of varying eccentricity that cooperate with connecting rods to reciprocate the needle bar. It is particularly desirable to able to change the length of the needle stroke of tufting machines without the necessity for removing the entire drive shaft of the machine. Furthermore, when operating the tufting machine at high speeds, any forces acting on the tufting machine that are not properly counterbalanced tend to set up a vibration in the tufting machine. At typical high speed operation involving 1500 to 1800 stitches per minute, even small issues of imbalance may create vibrations which will damage the tufting machine or its mountings.

In tufting machines, one or more rows of yarn carrying needles are reciprocally driven through a backing material fed through the machine across a bed plate to form loops that are seized by loopers oscillating below the backing material and bed plate in timed relationship with the needles. To change the depth of pile height produced by a tufting machine, it is necessary to change the length of the stroke of the needles, and the elevation of the bed plate relative to the loopers, as is well known in the prior art and described in U.S. Pat. No. 2,977,905. The actual bottom point of the stroke of the needles must remain constant so that the loopers and needles retain their proper relationship. Otherwise, the loopers will not properly seize the loops of yarn from the needles. To maintain this relationship a variety of methods have been utilized including using interchangeable push rods or connecting rods of varying lengths; using shims; or using adjustable length push rods or connecting rods. In order to properly maintain the relationship between the needles and loopers, changes to the length of the needle stroke as well as the attendant adjustments are generally performed with the tufting machine stopped at bottom dead center of the needle stroke.

Changing the stroke in high speed tufting machines has previously been accomplished by three general constructions. In one construction, the eccentrics are adjustable. The most widely used adjustable eccentrics involve two non-adjustable hubs which can be clamped tightly against the eccentric. When the hubs are loosened, the eccentric can be adjusted to alter its throw. Other types of adjustable eccentrics have generally either involved too many parts and adjustments to make changes in stroke length quickly and correctly, or have lacked the structural stability required to withstand the radial forces of driving the connecting rod and needle assembly at high speeds. Examples of such adjustable eccentrics are illustrated in U.S. Pat. Nos. 3,857,345 and 4,515,096. In a second type of general type of construction, two or three eccentrics of different throws are mounted on the rotating shaft adjacent to each connecting rod. To adjust the stroke, the eccentric strap is loosened and the eccentric with the desired throw is engaged. This leaves unused eccentrics mounted on the rotating shaft. In a third construction, split eccentrics are joined about the rotating shaft and can be disassembled and replaced with alternate eccentrics of a different throw when desired, as described in U.S. Pat. No. 5,320,053.

An alternative to these types of construction permitting adjustable throw length from a main drive shaft is the utilization of stub shafts with belt or chain drive connections to the main drive shaft. In this type of assembly, a main drive shaft is mounted with several sheaves across its length, and these sheaves engage by belt or chain with sheaves on associated stub shafts on which eccentrics may be mounted. Thus, when it is desired to change the throw of the tufting machine, it is not necessary to pull the main drive shaft, but only the stub shafts. Various assemblies of this nature are described in U.S. Pat. Nos. 4,665,845; 5,572,939; 5,706,745 and 5,857,422.

Whenever the throw or stroke of the tufting machine is changed, slight variations in balance and counterbalance are introduced. Furthermore, tufting machines may be operated at different speeds due to the change in the length of the stroke of the needles. Generally longer strokes entail slower speeds than shorter strokes and the variation in stroke and speed affects the vibratory characteristics of the tufting machine. Indeed, changing either the length of the stroke or the speed of operation of the tufting machine alone may alter the vibratory characteristics of the machine. It is often desirable to change the speed of operation to slower speeds when tufting patterns with lateral needle bar shifts, particularly shifts of multiple gauge units. It may also be desirable to operate at slower speeds when tufting with bulky yarns relative to tufting with smooth, narrow yarns. Each yarn and pattern combination may have a speed that is a "sweet spot" for optimal tufting performance that minimizes the number of yarns dropped from loopers. Therefore, it is necessary to minimize tufting machine vibrations over a range of throw lengths and operating speeds.

The counter balancing weights heretofore used to minimize vibration in tufting machines have principally been located either on the main drive shaft or on a shaft driven in synchronization from the main drive shaft or main drive motors. Often these counter balancing mechanisms are not adjustable over changes in length of stroke or speed of tufting machine operation. When counter balancing mechanisms have been adjustable, the adjustments are cumbersome, frequently requiring opening the tufting machine head and always requiring the tufting machine to be stopped.

What is needed therefore is an improved mechanism to reduce vibration in tufting machines that is easily adjustable over a range of throw lengths and speeds of tufting machine operation. According to the invention, a shaker driven by a servo motor independent of the main drive motor is utilized to rotate a counter balancing weight to act in opposition to the vibration of the tufting machine.

BRIEF DESCRIPTION OF THE DRAWINGS

The particular features and advantages of the invention as well as other objects will be become apparent from the following description taken in connection with the accompanying drawings in which.

DETAILED DESCRIPTION OF THE ILLUSTRATED EMBODIMENT

Figures 1, 2:
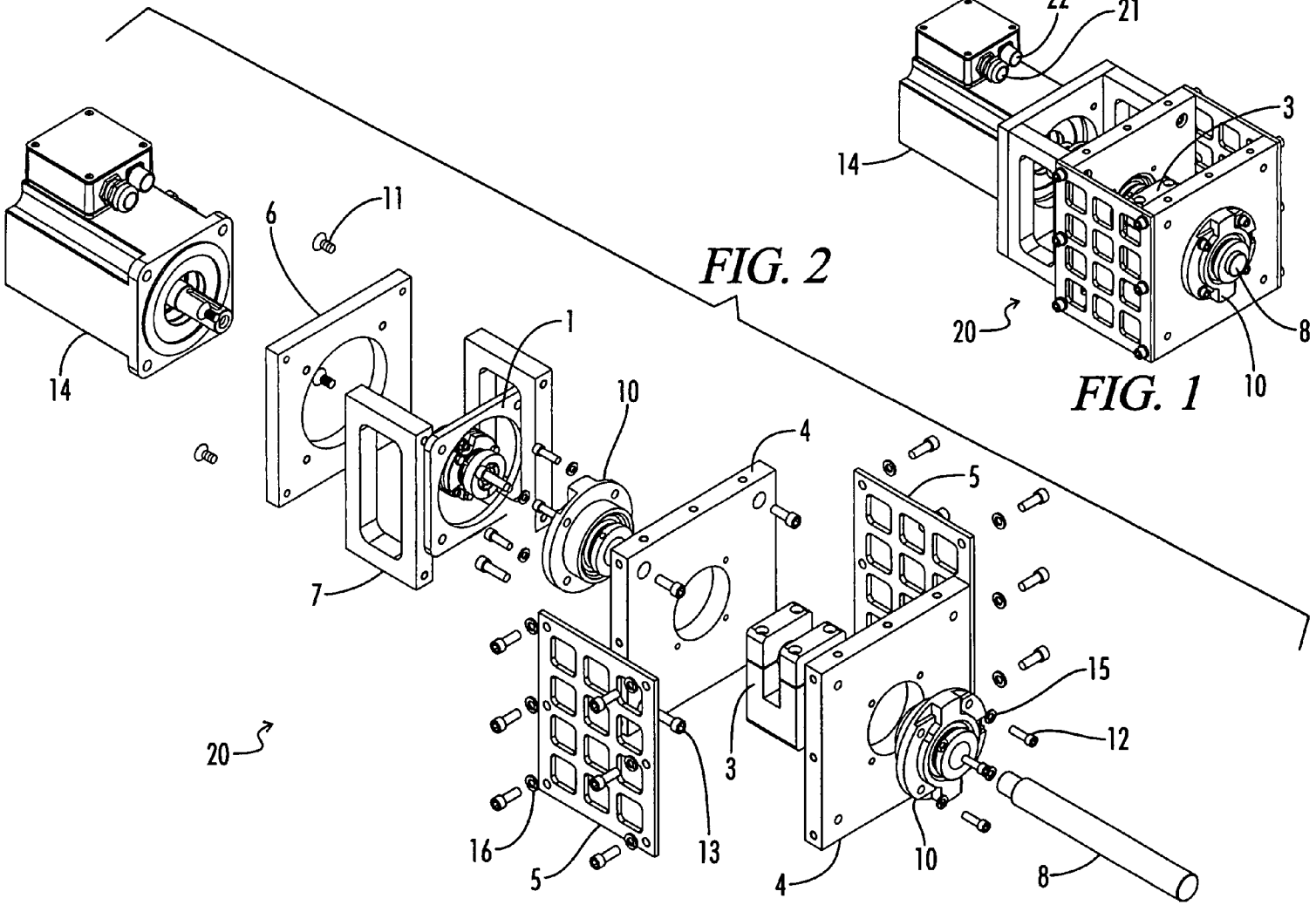
FIG. 1 is a perspective view of an exemplary servo driven shaker assembly utilized in the present invention.
FIG. 2 is an exploded perspective view of a servo driven shaker assembly of FIG. 1.

Referring now to the drawings, FIG. 1 generally illustrates an exemplary direct servo motor driven shaker assembly 20 with servo motor 14 coupled to a shaker stub shaft 8 journaled for rotation in bearing assemblies 10 and carrying thereon counter balancing weight 3.

Figure 8:
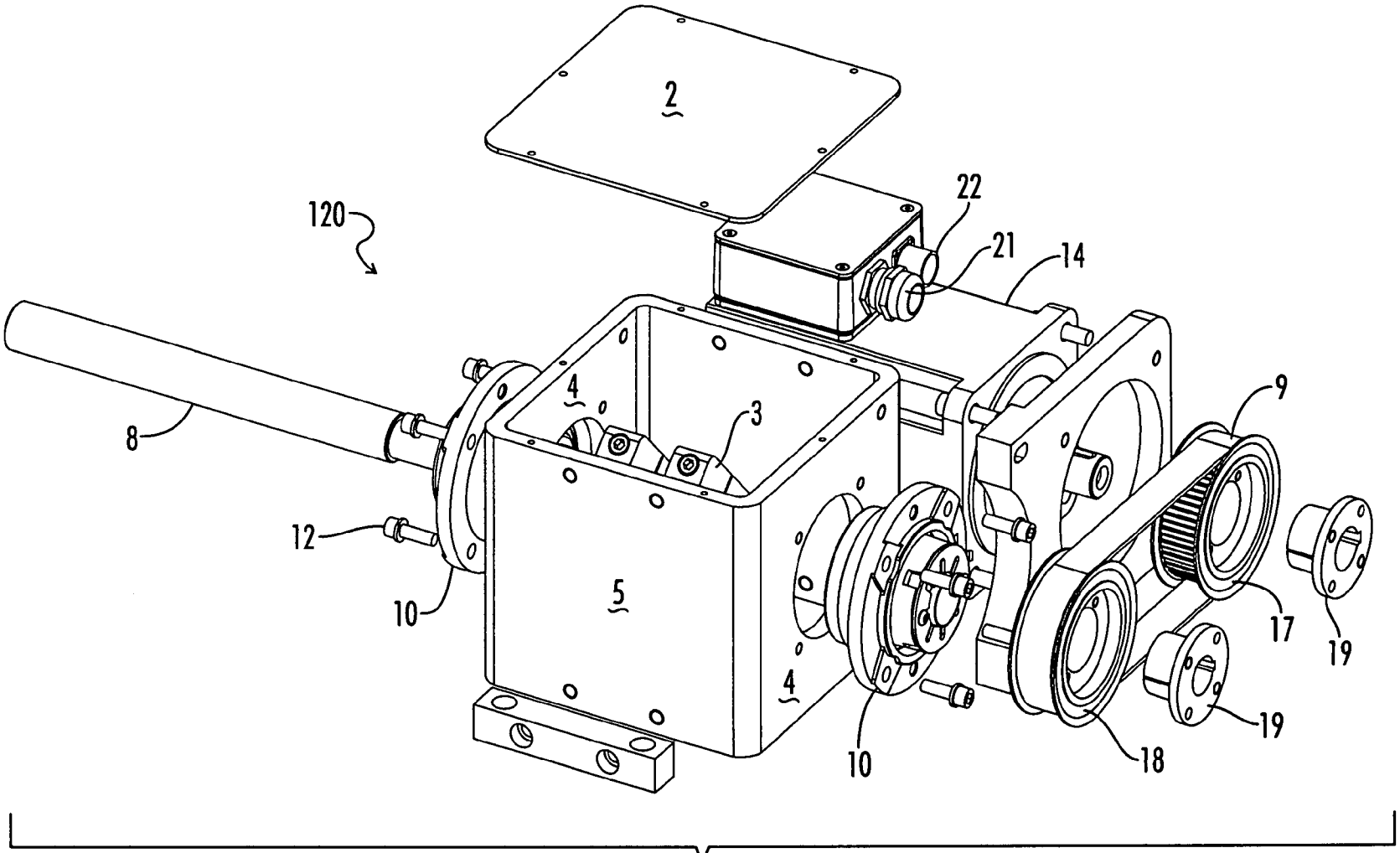
FIG. 8 is an exploded perspective view of a belt driven shaken assembly and associated servo motor.

FIG. 2 shows the servo motor driven shaker assembly 20 in greater detail with shaft coupling 1, bearing plates 4, side plates 5, motor mount plate 6, motor standoffs 7, and assorted screws 11, 12, 13, and lock washers 15, 16. Shaker assemblies are often used to impart a vibration to a sheet or container to facilitate processing of materials. However, the present application of shaker assemblies is intended to dampen vibration. To this end, the electrical connections to the servo motor include power 21 and a position signal 22 typically from a resolver providing information to an associated drive motor controller as to the rotational position of the shaft of the motor 14. While the illustrated directly connected motor 14 and shaft 8 is preferred, it is also possible to connect the motor 14 to drive the shaft 8 through a belt or chain drive as illustrated in FIG. 8. While a belt or chain drive is not as precisely controllable, it may allow for more optimal use of available space and for more easily realized changes in the ratio of motor revolutions to shaft revolutions to provide a mechanical advantage.

Figure 3A:
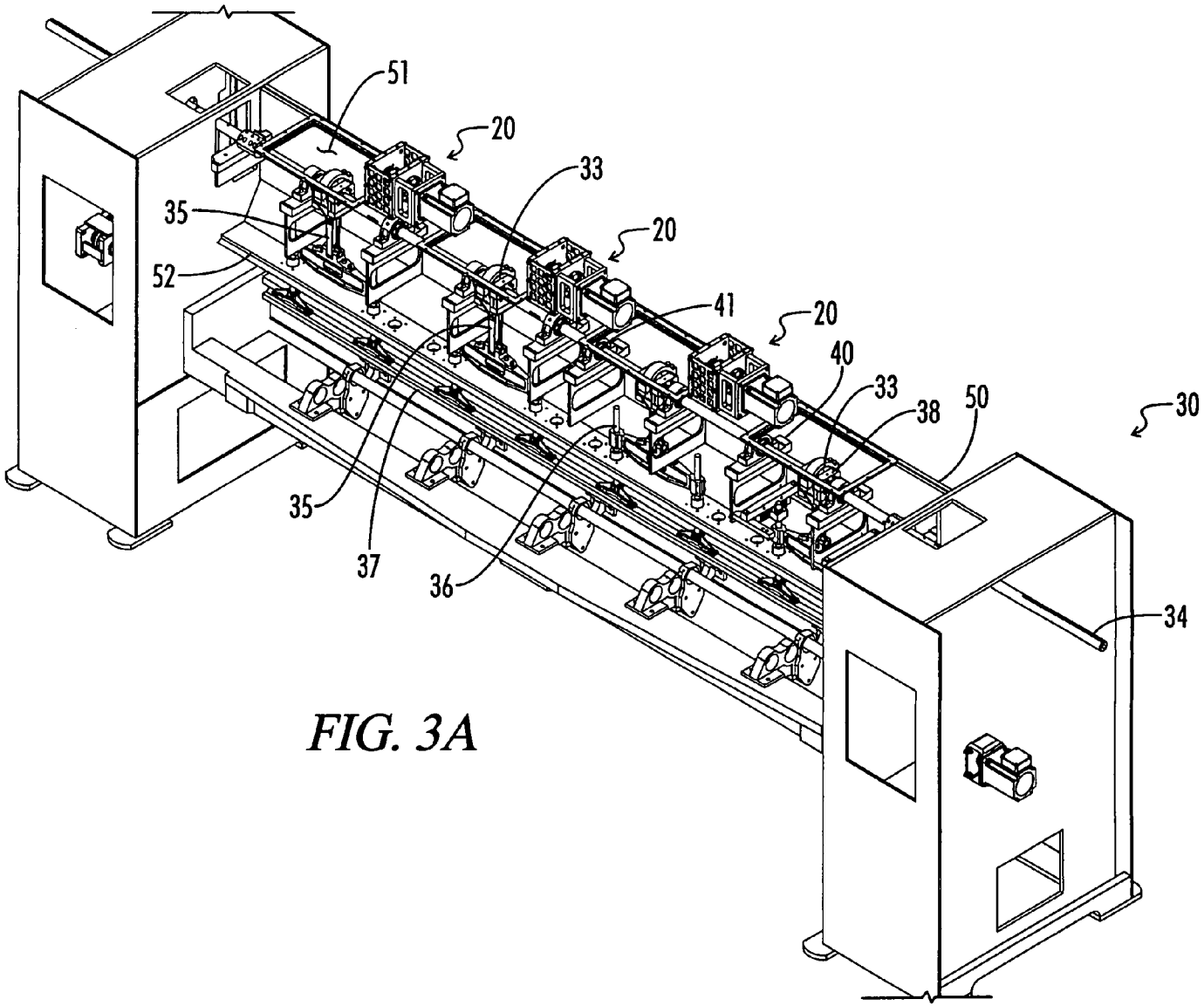
FIG. 3A is an exemplary high speed tufting machine with the head covering removed showing the mounting of three servo driven shaker assemblies.
Figure 4B:
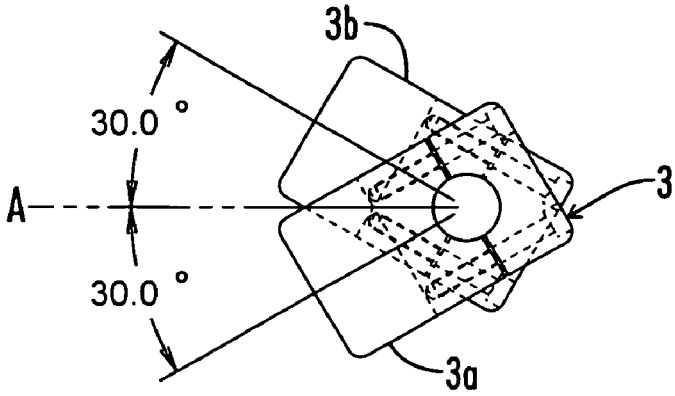
FIG. 4B is a plan view illustrating the adjustable orientation of counterweights on the stub shaft of a shaker assembly.
Figure 4A:
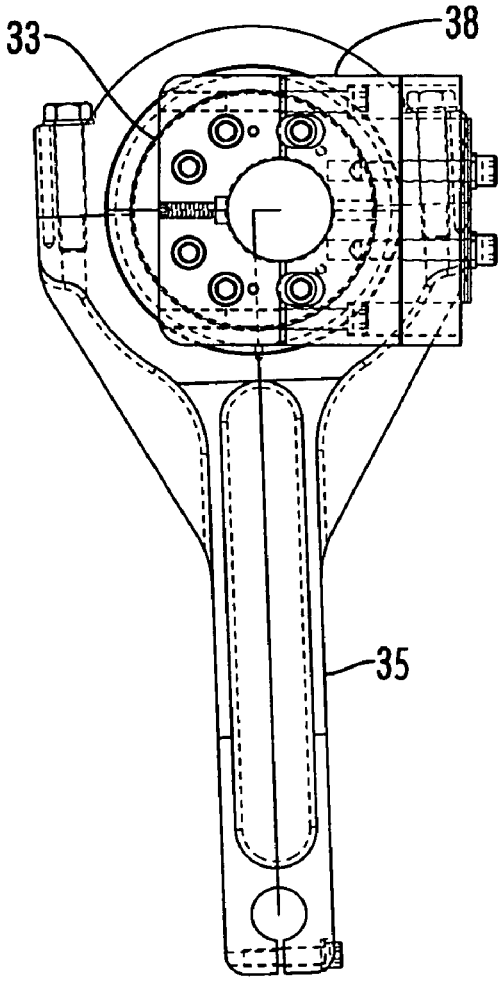
FIG. 4A is an end view of an eccentric and counterweight assembly mounted on a main drive shaft with a connecting rod.

FIG. 3A illustrates a tufting machine 30 having a main drive shaft 34 on which are mounted a plurality of eccentrics 33 with associated connecting rods 35. Upon rotation of the main drive shaft 34, the eccentrics 33 drive the connecting rods 35 which are connected to push rods 36 which in turn communicate reciprocal motion to the needle bar 37. In addition to the eccentrics 33, a counter weight portion 38, best seen in FIG. 4A, is added to provide rotational balance to the drive shaft 34 and minimize vibration. In spite of the best attempts to achieve rotational balance, which in some instances have become very complex, there has remained some residual vibration when tufting machines are operated at high speeds. Attempts to provide balance have included adding additional counter weights to the main drive shaft, adding additional eccentrics driving dummy connecting rods in an opposed reciprocal cycle to the reciprocation of the connecting rods 35 associated with needle bar 37; or in the case of driven stub shafts, driving alternate stub shafts in opposite directions.

Figure 3B:
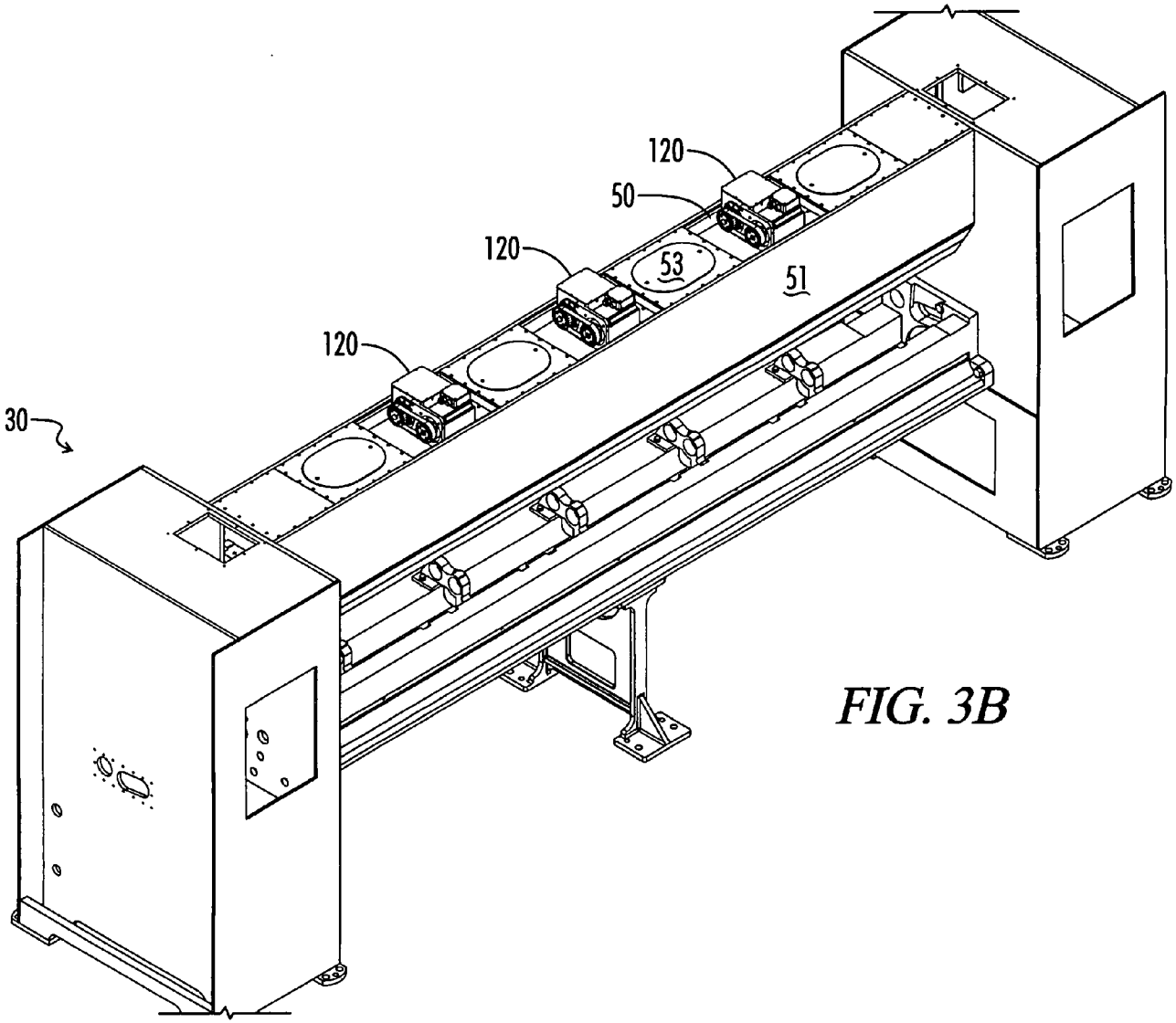
FIG. 3B is a reverse angle view of a high speed tufting machine with head cover in place showing the mounting of three belt driven shaker assemblies.

The head of the tufting machine typically has a top frame 50 and side walls 51 extending downward to a base 52. In FIG. 3A, only the back side wall 51 is shown, although lateral supports 40 fitted with bearings 41 to support the main drive shaft 34 extend laterally between front and rear side walls 51. In the illustrated embodiment of FIG. 3A, three direct drive shaker assemblies 20 are mounted to the top frame 50 of the head of the tufting machine. Alternatively, shakers may be mounted to side walls 51, preferably in proximity to one or more lateral supports 40. In FIG. 3B, the tufting machine 30 is illustrated with belt driven shakers 120 and the head of the machine 30 is depicted in its ordinary closed configuration with side wall 51 and head covers 53 in place. The head covers 53 can be removed to provide access to the main drive shaft and other components within the head of machine 30.

When the tufting machine 30 is operated at high speed, vibration can be detected and the shaker assemblies 20 programmed to rotate their associated counter balancing weights 30 in a fashion to minimize vibration in the tufting machine head. A typical counter balancing weight 3 is approximately four kilograms in weight and the position of the weight 3 may be adjusted as shown in FIG. 4B so that the vertical and horizontal components of the rotation of the counter balancing weight act in opposition to the vibration of the tufting machine 30 and very nearly cancel the vibration of the tufting machine head. When the eccentrics are changed to alter the throw of the connecting rods and thereby tuft a different height of yarn, the optimal location of the counter balancing weight 3 relative to the needle stroke may be adjusted electronically, eliminating the need for time consuming manual adjustment of counterweights. In fact, with an appropriate interface to the controller of the system, it is even possible to adjust the location of the counter balancing weight 3 relative to the needle stroke during tufting machine operation.

As will be seen in FIGS. 4A and 4B counterweight 38 provides rotational balance to the drive shaft which will typically account for at least about half of the imbalance associated with the eccentrics 33 and connecting rods 35. The weights 3 on the shakers 20 provide the remainder of the needed rotational balance. If only one size of eccentric 33 were to be utilized, all of the weights 3 could be aligned together in an optimum position relative to the rotational position of the drive shaft and in operation would provide optimal damping for the tufting machine head. However, from time to time the eccentrics 33 are changed so that the tufting machine will have a longer or shorter throw to thereby tuft higher or lower pile height yarns in the carpet backing. Thus, if for instance, at a ⅜ inch pile height, the optimal positioning of the shaker weights 3 is in line with horizontal axis A shown in FIG. 4B, when the eccentrics are changed to tuft lower pile height yarns, say ¼ inch pile height, it may be necessary to reduce the rotational antivibratory effect of the shakers 20. This can be accomplished by rotating the shaker weights 3 out of alignment with axis A so that on a two shaker configuration the weight 3*b* on the first shaker 20 might be rotated 30 degrees clockwise and the weight 3*a* on a second shaker might be rotated 30 degrees counterclockwise. The net effect of this rotation would be produce approximately 86% of the dampening effect that was achieved when the weights 3 were aligned with axis A [cosine (30°)≈0.86]. A more typical shaker configuration might involve the use of three shakers 20 on the tufting machine head and in that case the shaker weights 3 on the shakers located nearest each end of the tufting machine head might be advanced in a clockwise fashion by about 55 degrees and the balancing weight 3*b* of the center shaker might be rotated counterclockwise by about 40 degrees to produce the desired cancellation of vibration of the tufting machine head.

It can be appreciated that with an adequate controller, the angular rotation of balancing weights 3 with respect to angular rotation of the drive shaft of the tufting machine can be optimized across the entire range of sizes of eccentrics. The adjustments to the angular orientation of weights 3 can be accomplished in a variety of ways. For instance, a tufting machine operator may be provided with a table and the angular orientations of the counterweights manually set to correspond to the table of desired settings. Alternatively, the table of settings can be embedded in controller logic and the tufting machine operator may only need to select the throw of the eccentrics being used. Another option is for the tufting mill to have a vibration sensor or accelerometer to utilize in optimizing the setting of shaker weights after each change of eccentrics. Alternatively, a vibration sensor may be integrated with the shaker control system and remain permanently a part of the tufting machine.

It will be understood that the vibration damping benefit may be realized with only a single shaker assembly 20 associated with the tufting machine head, however, the most effective vibration damping is realized with two or more shaker assemblies spaced apart on the head of the tufting machine. As illustrated below in connection with FIGS. 6A, 6B, further benefits may be realizes by damping the vibrations of the bedframe of the tufting machine.

Figure 5A:
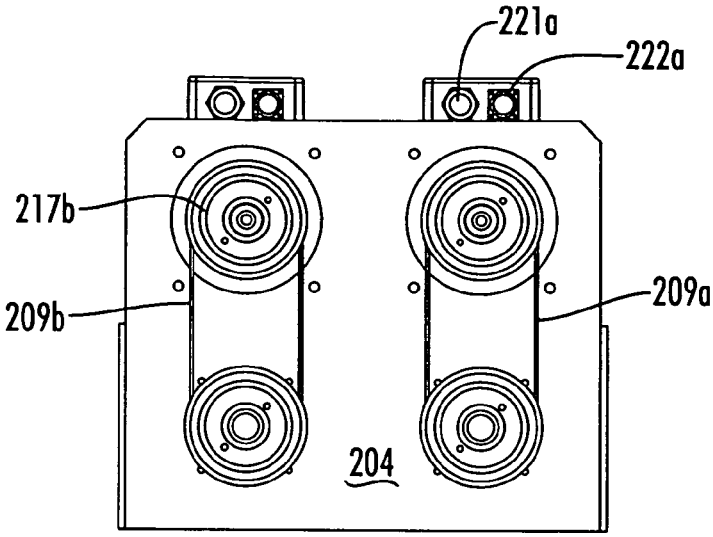
FIG. 5A is an end view of a two motor dual shaker assembly.
Figure 5B:
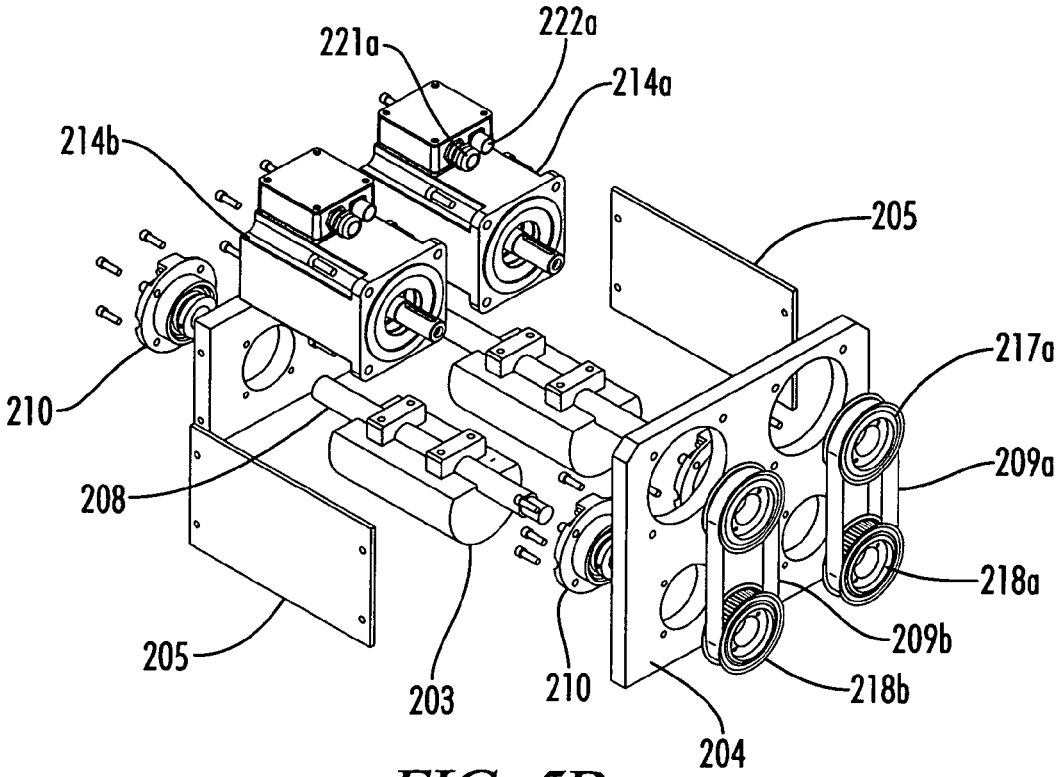
FIG. 5B is an exploded perspective view of the dual shaker assembly of FIG. 5A.

FIGS. 5A and 5B illustrate an alternative double counter weight system that may be utilized to apply antivibratory forces in a single plane. In the illustrated embodiment two motors 214*a*, 214*b* are utilized to drive two counter weights 203 mounted to rotating shafts 208 journaled in bearings 210. The rotational force applied by gears 217*a*, 217*b* driven by servo motors 214*a*, 214*b* is communicated by belts 209*a*, 209*b* to gears 218*a*, 218*b* that are connected to shafts 208 carrying balancing weights 203. Preferably the first motor is driven in a clockwise direction and the second motor is driven in a counter-clockwise direction so that except for the times when the weights are in an aligned position, the two rotating counter weights off-set one another and the antivibratory affect is applied only in a single plane. The illustrated counter weights 203 are relatively large, being scaled to weigh about six to ten kilograms, and are especially adapted to be utilized when a tufting machine is operating with an extremely long stroke as might be utilized to manufacture artificial turf or shag carpeting. It will also be appreciated that a single motor could be utilized with a belt configured to drive the balancing weights 203 in opposite rotational directions if desired.

Figure 6A:
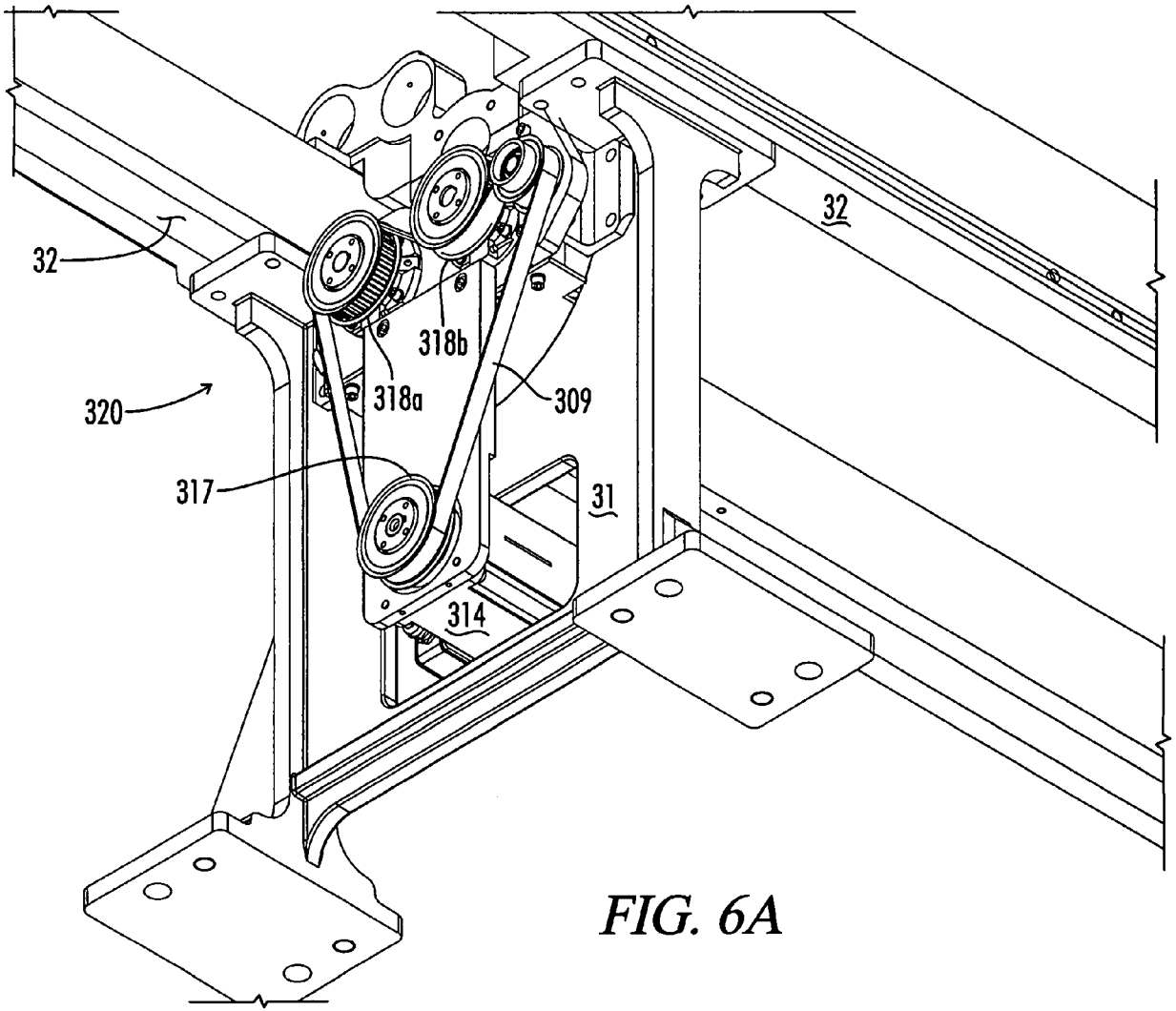
FIG. 6A is a bottom perspective view illustrating the mounting of a single motor dual shaker assembly to the bed frame of a tufting machine.
Figure 6B:
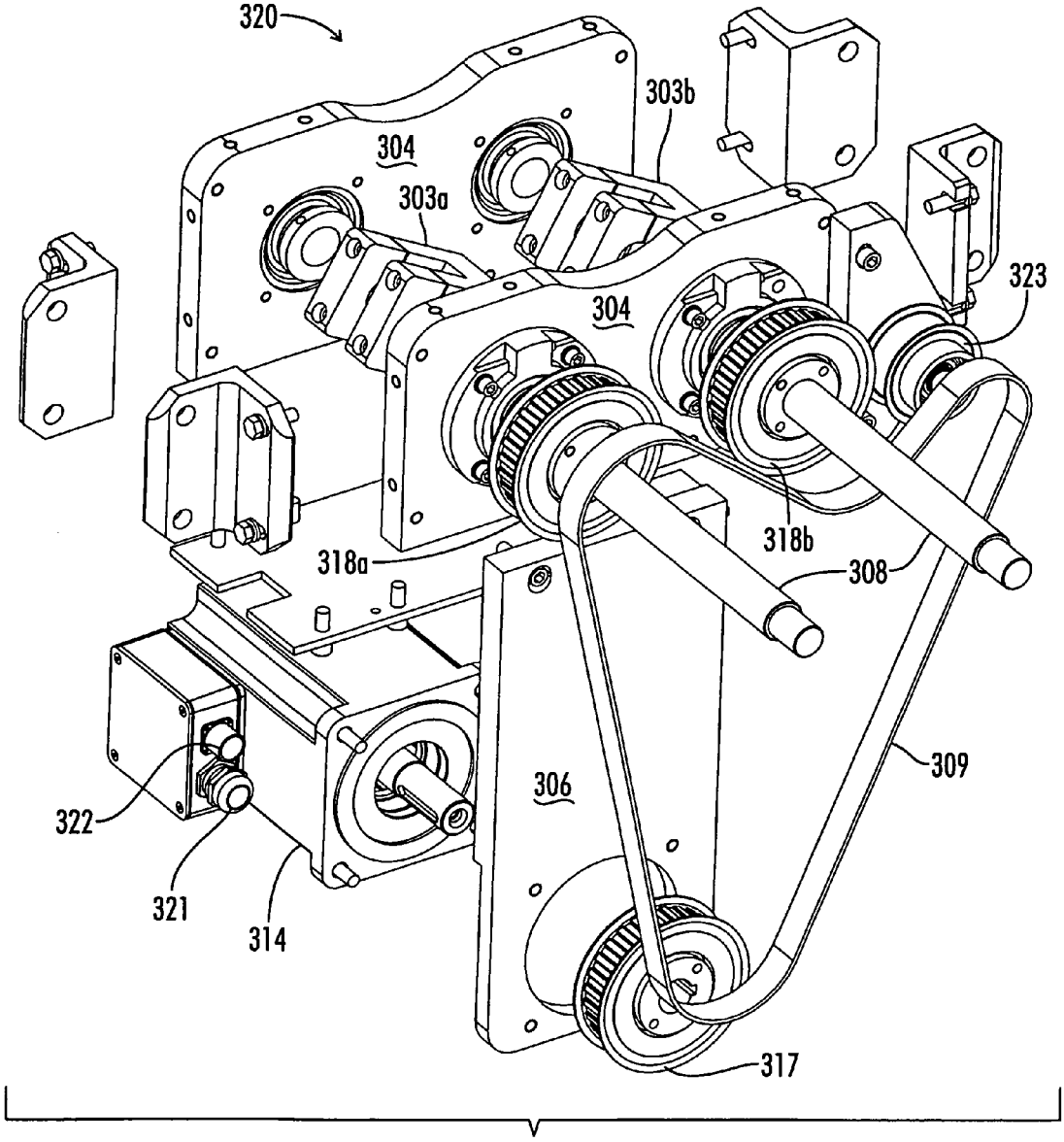
FIG. 6B is an exploded perspective view of the dual shaker assembly of FIG. 6A.

FIGS. 6A and 6B illustrate the use of a single belt 309 to rotate two weights 303*a*, 303*b* in opposite directions. This shaker assembly 320 is especially adapted to apply antivibratory affects to the bed frame 32 of the tufting machine by mounting the assembly to support structure 31 that is in turn directly connected to the bed frame. The vibratory motion that is most directly impacted by this shaker configuration are the oscillations created by the reciprocal movement of the hooks and knives used to seize and cut loops of tufted yarns. It can be seen that motor 314 applies rotational movement to gear 317 which in turn drives gear 318 that communicates with first shaft 308 carrying first counter weight 303*a* in the same rotational direction as the motor. Then the drive belt 309 communicates a motion to the second gear 318*b* in the opposite direction of the rotation of the motor thereby communicating opposite rotational movement to second counter weight 303*b*. These opposite rotational movements cause the antivibratory effect of the bed frame shaker 320 to be applied in a single plane which is most suitable to counteract the vibratory affects of the knife and looper assemblies. In order to complete a path of the drive belt 309, an additional wheel 323 is required, however this wheel does not drive any components.

FIG. 8 is an alternative embodiment of a signal counter weight shaker with motor 14 driving gear 17 held in place by locking hub 19. Gear 17 turns drive belt 9 which communicates rotational motion to gear 18 which is held in place on shaft 8 by locking hub 19. Shaft 8 rotates in bearings 10 that are supported in bearings plates 4 and the rotation of shaft 8 causes the rotation of balancing weight 3 just as in the case of the directly driven shaker assembly in FIG. 1. In the belt driven shaker 120, a cover is applied to conceal the operation of the balancing weight from view.

Figure 7:
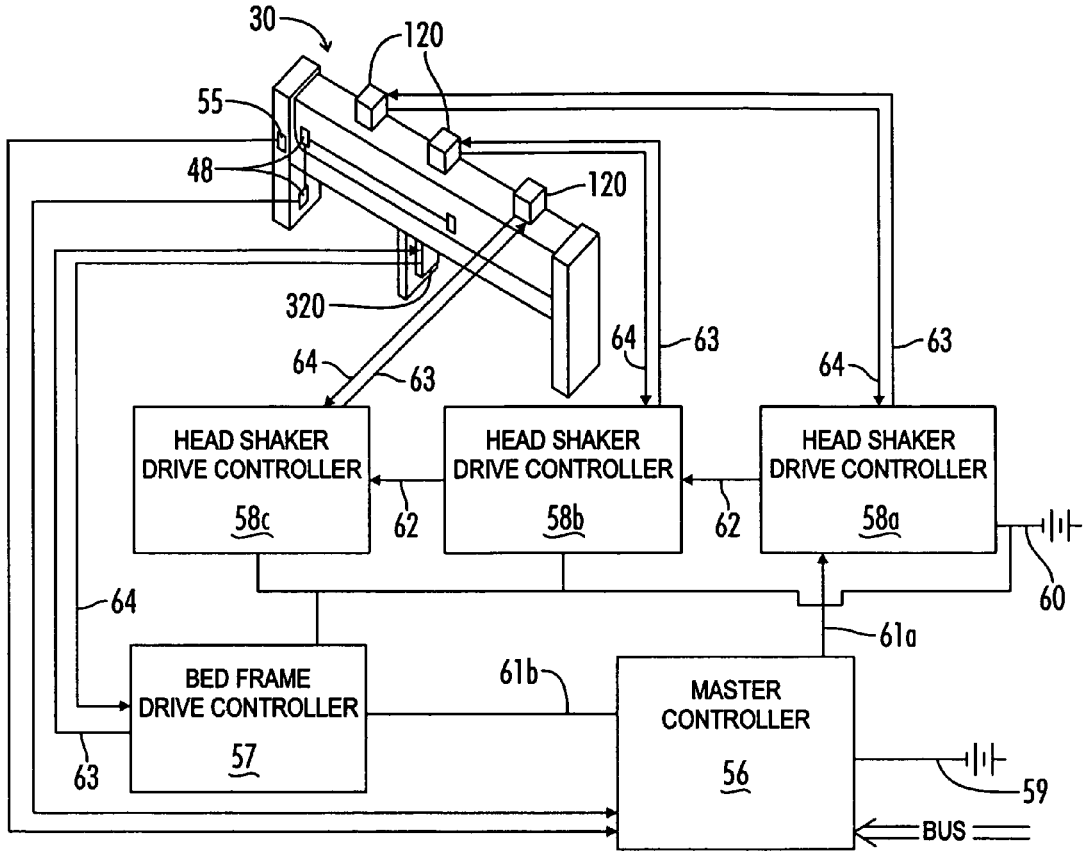
FIG. 7 is a simplified electrical schematic diagram of the controls for a vibration damping system of a tufting machine utilizing three head shakers and a bed frame shaker.

FIG. 7 is a simplified schematic illustration of the electronic controls for a vibration damping system of tufting machine 30 having three head shaker units 120 and a bed frame shaker 320. The master controller 56 receives power 59, typically at about 24 volts, and communicates with the machine operator or machine controls via illustrated data bus. The master controller 56 also communicates with a motion sensing device such as resolver 55 or an encoder that captures the location or movement of the main drive shaft of the tufting machine and communicates this information to the master controller 56. It is generally preferred to utilize a resolver that provides the absolute position of the main drive shaft for this purpose, in lieu of an encoder that only indicates relative movement. The master controller 56 then preferably communicates by industrial bus protocol, such as CAN bus, with drive controllers 57,58, for the head shakers and bed frame shaker. In the illustrated embodiment, a single CAN bus connection 61*a* is directed to a first head shaker drive controller 58*a* and that controller is connected in turn by a data connection 62 to second head shaker drive controller 58*b* and then on to third head shaker drive controller 58*c*. Separate connections to the drive controllers could be used if warranted by the amount of data communications. A second CAN bus connection 61*b* allows the master controller 56 to communicate with the bed frame drive controller 57. The drive controllers 57,58 are most typically configured to control high voltage as the electric current that is directed by these controllers to the motors of the shakers 120, 320 must be sufficient to power the motors rotation through relatively high speed operation. A high voltage power supply 60 is connected to and controlled by drive controllers 57, 58. Each drive controller communicates by a power connection 63 and a data connection 64 to its associated shaker motor. Thus, at a given instant, the master controller 56 determines the rotational position of the main drive shaft of the tufting machine 30 and communicates to drive controllers 57, 58 the desired positions of their associated motors and balancing weights. The drive controllers 57,58 determine by communication with their associated motors those motors current rotational positions and then supply power via electrical conduit 63 sufficient to move the associated motor to the newly desired location. These positional computations may be made with great frequency, on the order of several thousand times per second.

Furthermore, the master controller 56 may be designed to receive additional data from vibration sensors such as accelerometer 48 mounted to or within tufting machine 30. In this fashion, the master controller may initiate modifications to the antivibratory instructions directed to its associated shaker devices 120, 320. The master controller 56 may also implement more sophisticated instructions so that for a cycle of the main drive shaft the balancing weight is rotated faster than the main drive shaft during a portion of the cycle and is rotated more slowly than the main drive shaft during another portion of the cycle to increase or decrease the damping effect at optimal times. Numerous alternatives to the illustrated configuration are possible and as mentioned previously the master controller may be provided with instructions from an operator utilizing a table, or by an operator utilizing vibration censors that are not in direct communication with the master controller. Alternatively, the table of settings may be embedded in the master controller logic. Furthermore, in the case of an automated tufting machine utilizing master controller for one or more of yarn feed, needle shifting, backing fabric control or other tufting machine functions, a single master controller may be utilized to control all or a subset of the servo motors driving these functions.

All publications, patents, and patent documents mentioned above are incorporated by reference herein as though individually incorporated by reference. Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. In a tufting machine of the type having a plurality of reciprocally driven needles by communication with a main drive shaft in the head of the tufting machine, a vibration damping shaker assembly on the tufting machine comprising a motion sensing device communicating information to a controller so that the controller can determine the position of the main drive shaft, and wherein the controller directs the operation of a first servo motor to cause the rotation of a first balancing weight in a fashion that damps the vibration of the tufting machine;

wherein the first servo motor and first balancing weight are mounted to the bed frame of the tufting machine.

2. In a tufting machine of the type having a plurality of reciprocally driven needles by communication with a main drive shaft in the head of the tufting machine, a vibration damping shaker assembly on the tufting machine comprising a motion sensing device communicating information to a controller so that the controller can determine the position of the main drive shaft, and wherein the controller directs the operation of a first servo motor to cause the rotation of a first balancing weight in a fashion that damps the vibration of the tufting machine;

wherein the controller directs the first balancing weight to rotate faster than the main drive shaft and more slowly than the main drive shaft during a cycle of reciprocation of the needles.

3. In a tufting machine of the type having a plurality of reciprocally driven needles by communication with a main drive shaft in the head of the tufting machine, a vibration damping shaker assembly on the tufting machine comprising a motion sensing device communicating information to a controller so that the controller can determine the position of the main drive shaft, and wherein the controller directs the operation of a first servo motor to cause the rotation of a first balancing weight in a fashion that damps the vibration of the tufting machine;

wherein the controller directs the operation of a second servo motor to cause the rotation of a second balancing weight.

4. The vibration damping shaker assembly of claim 3 wherein the first servo motor and first balancing weight and the second servo motor and second balancing weight are mounted to the head of the tufting machine.

5. The vibration damping shaker assembly of claim 3 wherein the rotational position of the first balancing weight and the second balancing weight are not aligned.

6. The vibration damping shaker assembly of claim 3 further comprising a vibration sensor.

7. The vibration damping shaker assembly of claim 3 wherein the operation of the first servo motor causes the rotation of the first balancing weight in a clockwise direction and the rotation of a third balancing weight in a counterclockwise direction.

8. The vibration damping shaker assembly of claim 3 wherein the controller directs the first balancing weight to rotate faster than the main drive shaft and more slowly than the main drive shaft during a cycle of reciprocation of the needles.

9. In a tufting machine of the type having a plurality of reciprocally driven needles by communication with a main drive shaft in the head of the tufting machine, a vibration damping shaker assembly on the tufting machine comprising a motion sensing device communicating information to a controller so that the controller can determine the position of the main drive shaft, and wherein the controller directs the operation of a first servo motor to cause the rotation of a first balancing weight in a fashion that damps the vibration of the tufting machine;

wherein the controller conveys instructions to a drive controller that dispenses electrical current to the first servo motor to control the rotation of the first balancing weight.

10. A tufting machine having:

a main needle drive motor operable to rotate a main drive shaft in a head of the tufting machine to reciprocably drive a plurality of needles;

a vibration damping shaker assembly having a first servo motor operable to rotate a first balancing weight;

a controller directing the operation of the first servo motor; and a motion sensing device communicating information to the controller;

wherein based upon information from the sensing device, the controller operates the first servo motor in a fashion that causes the rotation of the first balancing weight to damp the vibration of the tufting machine.

11. The tufting machine of claim 10 wherein the first servo motor and first balancing weight are mounted to the head of the tufting machine.

12. The tufting machine of claim 10 wherein the motion sensing device is a resolver.

13. The tufting machine of claim 10 wherein the motion sensing device is an encoder.

14. The tufting machine of claim 10 wherein the motion sensing device is a vibration sensor.

15. The tufting machine of claim 14 wherein the controller processes data from the vibration sensor to adopt an angular orientation of the first weight relative to the main drive shaft to minimize vibration of the tufting machine.

16. The tufting machine of claim 10 wherein the operation of the first servo motor causes the rotation of the first balancing weight in a clockwise direction and the rotation of a second balancing weight in a counterclockwise direction.

17. The tufting machine of claim 10 wherein an operator enters instructions for the angular orientation of the first weight relative to the main drive shaft based upon a table of needle stroke lengths.

18. The tufting machine of claim 10 wherein an operator enters a needle stoke length and the controller determines the angular orientation of the first weight relative to the main drive shaft from a table.

19. The tufting machine of claim 10 wherein the first servo motor and first balancing weight are mounted to the head of the tufting machine.

20. The vibration damping shaker assembly of claim 19 wherein the controller processes data from the vibration sensor to adopt an angular orientation of the first weight relative to the main drive shaft to minimize vibration of the tufting machine.

* * * * *